United States Patent [19]

Okamura et al.

[11] Patent Number: 5,061,325

[45] **Date of Patent: * Oct. 29, 1991**

[54] METHOD OF PRODUCING HIGH TENSION STEEL SUPERIOR IN WELDABILITY AND LOW-TEMPERATURE TOUGHNESS

[75] Inventors: Yoshihiro Okamura; Seinosuke Yano; Ryota Yamaba; Hidetaka Chiba, all of Tokai, Japan

[73] Assignee: Nippon Steel Corporation, Japan

[ * ] Notice: The portion of the term of this patent subsequent to Aug. 7, 2007 has been disclaimed.

[21] Appl. No.: 500,939

[22] Filed: Mar. 29, 1990

[30] Foreign Application Priority Data

Mar. 29, 1989 [JP] Japan ..... 1-077097

[51] Int. Cl.[5] ..... C21D 7/00

[52] U.S. Cl. ..... 148/12 F; 148/12 C; 148/12.4

[58] Field of Search ..... 148/12 F, 12 C, 12.4

[56] References Cited

U.S. PATENT DOCUMENTS 4,946,516 8/1990 Yano et al. ..... 148/12.4

FOREIGN PATENT DOCUMENTS 60-20461 5/1985 Japan .

60-25494 6/1985 Japan .

*Primary Examiner*—Deborah Yee

*Attorney, Agent, or Firm*—Pollock, Vande Sande & Priddy

[57] ABSTRACT

A method of high tension steel having superior weldability and low temperature toughness, comprises the steps of preparing a steel billet having a composition consisting, by weight, of 0.02 to 0.05% C, 0.02 to 0.5% Si, 0.4 to 1.5% Mn, 0.5 to 4.0% Ni, 0.20 to 1.5% Mo, 0.005 to 0.03% Ti, 0.01 to 0.08% Al, not more than 0.0002% B, 0.5 to 2.0% Cu, not more than 0.01% N, and the balance Fe and incidental impurities; heating said steel billet to a temperature of 900° C. to 1000° C.; hot-rolling the heated steel billet first at a rolling reduction of 30 to 70% in a temperature range in which austenite recrystallizes and then at a rolling reduction of 20 to 60% in another temperature range in which austenite does not recrystallize; hardening the hot-rolled billet by water-cooling from a temperature not lower than the $Ar_3$ transformation point and terminating the cooling at a temperature not higher than 250° C.; and tempering the hardened billet at a temperature which is not higher than the $Ac_1$ transformation point.

2 Claims, 1 Drawing Sheet

METHOD OF PRODUCING HIGH TENSION STEEL SUPERIOR IN WELDABILITY AND LOW-TEMPERATURE TOUGHNESS

BACKGROUND OF THE INVENTION

1. Field of the Invention

The present invention relates to a method of producing a high tension steel superior in weldability and low-temperature toughness, having yield strength not smaller than 70 kgf/mm$^2$ and tensile strength not smaller than 80 kgf/mm$^2$.

2. Description of the Related Art

In recent years, there is an increasing demand for energy. To cope with this demand, a trend or activity is becoming remarkable for building of welded steel structures intended for development and storage of energy resources, such as offshore structures for submarine resource exploitation, sea bottom researching vessels, pressure vessels for storing energy resources, and so forth. In general, these structures are large in size and, hence, constructed from steel members having large thicknesses. Accordingly, the requirement for safety is becoming more significant.

Steel members used for building of such structures are therefore required to have improved weldability and toughness. In case the structure is intended for use in a corrosive condition as in the case of a submarine structure or a crude oil tank, the material must have sufficient resistance to stress corrosion cracking.

A high tension steel having yield strength not smaller than 70 kgf/mm$^2$ and tensile strength not smaller than 80 kgf/mm$^2$ (referred to as "HT 80", hereinafter) is produced, for example, by a method using an effect of improving hardenability which effect is obtained by addition of a trace amount of B (boron). More specifically, in this method, excessive addition of hardenability-improving elements such as C, Ni, Cr and Mo is prohibited in order to reduce carbon equivalent which is one of the indices of weldability and, instead, an Al-B treatment or a treatment for reducing N content is conducted to fully utilize the hardenability-improving effect produced by B. The material is then formed into a product steel member through hardening/tempering after reheating or immediately after rolling. These methods are disclosed, for example, in Japanese Patent Examined Publication No. 60-25494 entitled METHOD OF PRODUCING BORON-CONTAINING LOW-ALLOY-TEMPERED HIGH-TENSION STEEL PLATE and Japanese Patent Examined Publication No. 60-20461 entitled THICK HIGH-TENSION STEEL PLATE HAVING HIGH STRENGTH AND TOUGHNESS. In these methods, a tempered martensitic structure or a tempered low bainite structure is obtained as a result of hardening/tempering, thus attaining high strength and toughness.

An Ni-Cu steel (ASTM 710 steel), having improved strength by precipitation hardening effect of Cu, is shown as a high-tension steel having a high tensile strength without relying upon B. This steel is produced by reheating hardening/tempering or reheating normalizing/tempering and is used as the material of high-tension steel member having tensile strength of 60 kgf/mm$^2$ or so.

The steel production method which relies upon the hardenability improving effect produced by B can reduce the contents of elements such as C, Ni, Cr and Mo so that the weldability is appreciably improved to such a degree as to prevent cracking even when pre-heating temperature is lowered before welding. This method, however, is still unsatisfactory in that it does not allow pre-heating before welding to be completely omitted. In addition, when a steel produced by this type of method is subjected to welding with a small heat input, the hardness of the heat affected zone (HAZ) affected by the welding heat is increased due to the hardenability improving effect produced by B, with the result that the stress corrosion cracking sensitivity is undesirably increased. When this method is applied to production of a member having large thickness, martensitic or lower bainite structure is obtained because of hardenability improvement effect produced by B in a region which is $\frac{1}{4}$ the whole thickness from the surface layer Unfortunately, however, toughness is insufficient in the core portion of the sheet due to occurrence of upper bainite structure.

SUMMARY OF THE INVENTION

Accordingly, an object of the present invention is to provide a method of producing a high-tension steel superior in weldability and low-temperature toughness, thereby overcoming the problems of the prior art.

The present inventors have conducted intense study and experiments with a view to develop a thick HT 80 steel which is superior in weldability, stress corrosion cracking resistance and low-temperature toughness. As a result, the inventors have found that B content seriously affects the hardness of HAZ even in low-carbon steels, so that the hardness of HAZ of welding can be remarkably reduced when B content not more than 0.0002% (substantially no addition of B) and C content not more than 0.05% are combined.

The inventors also found that a thick steel plate which is made from a steel having small C content and substantially no addition of B and which has high strength and high toughness uniformly in the thickness-wise direction can be obtained by making grain size fine and by utilizing precipitation hardening effect produced by Cu, even when an upper bainite structure occurs. Thus, the inventors have found that the above-mentioned thick steel plate can be obtained from a steel material having a small C content and substantially no addition of B content, by suitably selecting and combining steps and treatments such as heating, rolling, cooling and heat treatment.

On the basis of these knowledges, the present invention provides a method of producing a high tension steel superior in weldability and low temperature toughness, comprising the steps of: preparing a first steel billet consisting, by weight, of 0.02 to 0.05% C, 0.02 to 0.5% Si, 0.4 to 1.5% Mn, 0.5 to 4.0% Ni. 0.20 to 1.5% Mo, 0.005 to 0.03% Ti, 0.01 to 0.08% Al, not more than 0.0002% B, 0.5 to 2.0% Cu, not more than 0.01% N, and the balance Fe and incidental impurities or a second steel billet containing in addition to the constituents of the first steel billet at least one kind selected from the group consisting of Ca having a function of controlling the morphology of inclusions, and strength-improving elements consisting of 0.05 to 1.0% Cr, 0.005 to 0.10% V, and 0.005 to 0.05% Nb; heating said steel billet to a temperature of 900° C. to 1000° C.; hot-rolling the heated steel billet first at a rolling reduction of 30 to 70% in a temperature range in which austenite recrystallizes and then at a rolling reduction of 20 to 60% in another temperature range in which austenite does not recrystallizes; hardening the hot-rolled billet by commencing water-cooling from a temperature not lower than the $Ar_3$ transformation point and terminating the cooling at a temperature not higher than 250° C.; and tempering the hardened billet at a temperature not higher than the $Ac_1$ transformation point.

The method of the invention and its function will become more clear from the following description.

There are first explained below the reasons of limiting contents of the respective elements of the steel. In the following description, contents of elements are expressed in terms of weight percent unless otherwise specified.

C: C is an element which improves hardenability to facilitate improvement in strength. This element, however, causes undesirable effects on weldability and stress corrosion cracking resistance which are to be improved by the present invention. More specifically, as shown in FIG. 1, a C content not more than 0.05% causes a serious reduction in the hardness of the HAZ of welding, while a C content exceeding 0.05% causes hardening of the HAZ to impair weldability and to enhance stress corrosion cracking sensitivity, particularly when B content is not more than 0.0002%, i.e., substantially zero. On the other hand, a C content below 0.02% makes it impossible to obtain the required strength. For these reasons, the C content is determined to be 0.02% to 0.05%.

Si: Si is an element which is essential in making a steel. For enabling steel making, Si content should be 0.02% at the smallest. When the Si content exceeds 0.5%, toughness and weldability of the matrix steel, as well as toughness of HAZ, are undesirably reduced. The Si content is therefore determined to be 0.02% to 0.5%.

Mn: Mn is an element which improves hardenability to ensure toughness. When Mn content is 1.5% or greater, low-temperature toughness is reduced due to an increase in tempering embrittlement. On the other hand, Mn content below 0.4% causes a reduction in the strength and toughness. The Mn content is therefore determined to be 0.4% to 1.5%.

Cu: Cu is an element which males it possible to increase strength without impairing toughness and, hence, is one of the most important elements in the present invention. In order to compensate for reduction in the hardenability caused by reduction in the C content, it is necessary to increase the strength by precipitation hardening effect of Cu in the tempering which is conducted after hardening. To this end, the Cu content should be not less than 0.5%. Addition of Cu in excess of 2.0%, however, experiences a saturation in the effect of improving strength and, in addition, causes a reduction in the toughness. The Cu content therefore is determine to be not more than 2.0%.

Ni: Ni improves low-temperature toughness of steel and enhances strength of steel through improvement in hardenability. In addition, Ni produces an appreciable effect in preventing hot cracking and welding high-temperature cracking. In the method of the present invention, Ni also produces an effect to obtain generation of bainite structure of fine grains in hardening treatment. In order to attain an appreciable improvement in low-temperature toughness, the Ni content should be not less than 0.5%. The upper limit of Ni content is 4.0% because addition of Ni in excess of 4.0% causes a reduction in the weldability, as well as a rise in the cost because this element is expensive.

Mo: Mo is an element which is effective in assuring strength through improvement in hardenability and also in prevention of tempering embrittlement. This element also is one of the most important elements in the invention as is the case of Cu mentioned above. Namely, Mo can widen a non-recrystallization temperature-range to enable increase in dislocation density relating to Cu precipitation site, thus enhancing precipitation hardening effect of Cu. When the Mo content is below 0.2%, the effect for widening the non-recrystallization temperature range is so small as to make it impossible to obtain expected strength and toughness. On the other hand, Mo content exceeding 1.5% causes a reduction in the toughness due to an increase in the amount of carbides such as coarse $Mo_2C$, as well as an excessive hardening of HAZ of welding.

Ti: Ti prevents coarsening of austenite grains and is indispensable for attaining improvement in the toughness of HAZ. In the method of the present invention it is indispensable to employ the step of making austenitic grains fine in size at the time of heating of billet prior to rolling, in order to ensure that a sufficiently high level of toughness is realized even in the thicknesswise central portion of the steel sheet. To this end, Ti is added in such an amount that the ratio Ti/N ranges between 2.0 and 3.4. Thus, the Ti content depends on N content, but is determined to be 0.005 to 0.03% because a Ti content below 0.005% cannot provide sufficiently fine grain size while addition of Ti in excess of 0.03% causes reduction both in the toughness of the matrix material and toughness of HAZ.

Al: Al is an element which is necessary for deoxidation. This material also forms nitrides during heating of billet so as to contribute to make austenitic grains fine in grain size. Al content below 0.01% cannot provide appreciable effect, while addition of Al in excess of 0.08% is not recommended because toughness is impaired due to increase in alumina-type inclusions.

N: N forms carbonitrides together with Ti so as to prevent coarsening of austenitic structure. A too large N content, however, impairs toughness of HAZ so that the N content is limited to be more than 0.01%.

B: B is the most harmful element in the present invention because it causes undesirable effects such as hardening of HAZ and reduction in all of weld-cracking resistance, hardenability and stress corrosion cracking resistance. In particular, in case of a small-heat-input welding, HAZ is seriously hardened when B content exceeds 0.0002%, as shown in FIG. 2. The B content is therefore limited to be not more than 0.0002%.

According to the present invention, one, two or more of Cr, V, Nb and Ca are added in addition to the above-mentioned basic elements. Cr, V and Nb have an equivalent effect in improving strength of the steel. In order to obtain an expected result, the Cr content, V content and Nb content, respectively, should be not less than 0.05%, 0.005% and 0.005%. On the other hand, a Cr content exceeding 1.0%, V content exceeding 0.10% and Nb content exceeding 0.05% cause problems such as increased stress corrosion cracking sensitivity, increased hardenability at welding and reduction in the toughness of HAZ of welding. The contents of these additional elements therefore are restricted as shown above.

Ca: Ca is effective in spheroidization of non-metal inclusions and is effective in reducing anisotropy of the toughness. Ca also is effective in preventing cracking attributable to stress-relief annealing after welding.

However, Ca content exceeding 0.0050% causes a reduction in the toughness due to an increase in inclusions.

Incidental impurities such as P, S and so forth may be included in addition to the elements mentioned above. The amounts of these impurities must be made to be small, because these impurities are harmful elements which reduce toughness which is to be improved by the present invention. More specifically, the P and S contents should be not more than 0.010% and not more than 0.005%, respectively.

The above-described steel composition is one of the features of the invention. A description will now given of the conditions of processes which form another feature of the present invention. The object of the invention, i.e., sufficient precipitation hardening effect of Cu and uniform thicknesswise distribution of high toughness in thick steel plate, cannot be obtained unless a suitable process is executed, even when the steel composition meets the ranges specified above. A description therefore will be given as to the reasons of limitation of conditions for heating, rolling, cooling and tempering.

According to the present invention, a steel billet of the above-described composition is heated to a temperature of 900 to 1000° C. and subjected to a hot rolling, for the following reasons. Namely, in the present invention, the grains in the steel billet are made to be sufficiently fine despite the formation of upper bainite structure to obtain high toughness so that a high level of toughness is attained even in the thicknesswise core portion of a thick steel plate. This requires that heated austenitic grains are made to be fine in size. On the other hand, in order to attain the desired strength, it is necessary that Cu, Mo and so forth are sufficiently in solid solution state at the temperature to which the steel is heated, and that sufficient hardening is attained by precipitation of Cu and Mo through a tempering treatment. Thus, the temperature of the heating before hot rolling has to be selected to satisfy both the demand for making austenitic grains fine and the demand for preparing sufficient solid solution of Cu and Mo. The solid solution action is insufficient when the temperature to which the steel is heated is below 900° C. In particular, presence of non-dissolved precipitates such as $M_6C$ makes it difficult to obtain a sufficient precipitation hardening effect in the tempering treatment and causes a reduction in the toughness. On the other hand, heating to a temperature exceeding 1000° C. causes a coarsening of austenitic grains. Once the grains are coarsened, it is difficult to make these grains fine in grain size even in the subsequent controlled rolling, so that the upper bainite structure cannot be toughened to a desired level. For these reasons, the temperature to which the steel is heated prior to the hot rolling is determined to be 900° C. to 1000° C.

According to the invention, the hot rolling is conducted first at a rolling reduction of 30 to 70% in a temperature range in which austenite is recrystallized and then at a rolling reduction of 20 to 60% in another temperature range (non-recrystallization temperature range) in which austenite does not recrystallize. These rolling conditions are necessarily adopted for the following reasons.

Namely, these hot-rolling conditions are adopted to attain, in addition to making austenitic grains fine in size, an increase in dislocation density through formation of a deformation band in austenitic grains, so as to positively make precipitation of precipitates occur in the positions of dislocations during tempering, thereby enhancing precipitation strengthening effect. If the rolling reduction in the recrystallizing temperature range is decreased while the rolling reduction in the non-recrystallization temperature range is increased, austenitic grains will be insufficiently made to be fine in size with the results that coarse austenitic grains are formed to seriously increase anisotropy of both strength and toughness and to cause higher stress corrosion cracking sensitivity. On the other hand, if the rolling reduction in the recrystallizing temperature range is increased while the rolling reduction in the non-recrystallization temperature range is decreased, formation of deformation band in the austenitic grains becomes insufficient to make it impossible to obtain a desired precipitation strengthening effect, although the austenitic grains are made to be fine in size.

For these reasons, the rolling reductions in the recrystallizing temperature range and in the non-recrystallization temperature range are determined to be in ranges of 30% to 70% and of 20% to 60%, respectively.

According to the invention, it is necessary to conduct a hardening treatment which is commenced by water-cooling from a temperature not lower than $Ar_3$ transformation temperature and terminates at a temperature which is not higher than 250° C. Air cooling cannot be used because there occur both precipitation of Cu and over-aging in the course of cooling, so that it becomes impossible to obtain sufficient precipitation hardening effect which is to be attained by the subsequent tempering treatment. In addition, strength and toughness possessed by an HT 80 steel cannot be obtained with a structure having ferrite. In order to obtain a fine bainite structure, the hardening should be conducted by water-cooling from a temperature which is not lower than $Ar_3$ transformation point.

In the method of the present invention, the temperature at which the water-cooling terminates should not exceed 250° C., because termination at a higher temperature causes an insufficient precipitation hardening during temperature to thereby reduce the strength of the steel sheet. In particular, uniformity of properties in the thicknesswise direction in the plate is impaired when the product plate has a large thickness. The austenitic grains hardened immediately after hot rolling are finer in size than those obtained through hardening conducted after a reheating.

The steel hot-rolled and then water-cooled has to be subjected to a tempering treatment which is conducted at a temperature not higher than $Ac_1$ transformation point. This tempering treatment is conducted for the purpose of allowing sufficient precipitation of Cu, Mo and etc. to obtain a sufficient precipitation hardening effect thereby enhancing strength and toughness. Tempering is necessary also for preventing softening of welded steel which softening is attributable to annealing conducted for the purpose of stress relieving. A tempering temperature exceeding $Ac_1$ transformation point causes a serious reduction in the strength, as well as noticeable reduction in toughness. For these reasons, the tempering temperature is determined to be not higher than $Ac_1$ transformation point.

A steel plate product produced through the described process exhibits high strength and high toughness with high uniformity in the thicknesswise direction of the plate, despite the reduced carbon content. In addition, hardening tendency of HAZ of welding is remarkably reduced to enable the welding of this steel plate to be conducted at normal temperature. Furthermore, stress corrosion cracking resistance is also improved remarkably.

DESCRIPTION OF THE EMBODIMENTS

Figure 1:
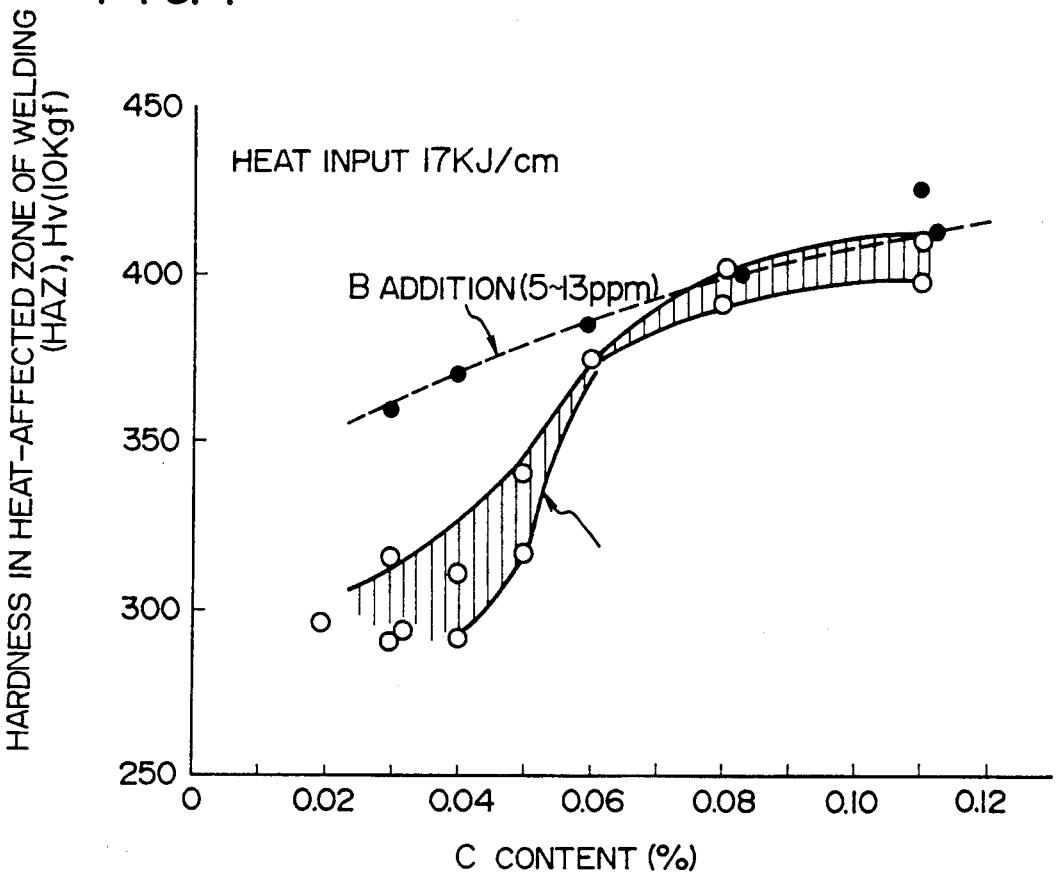
FIG. 1 is a graph showing influence of C content of a steel composition on a HAZ of welding as observed in a case where B is added and in another case where B is not added to the steel composition.
Figure 2:
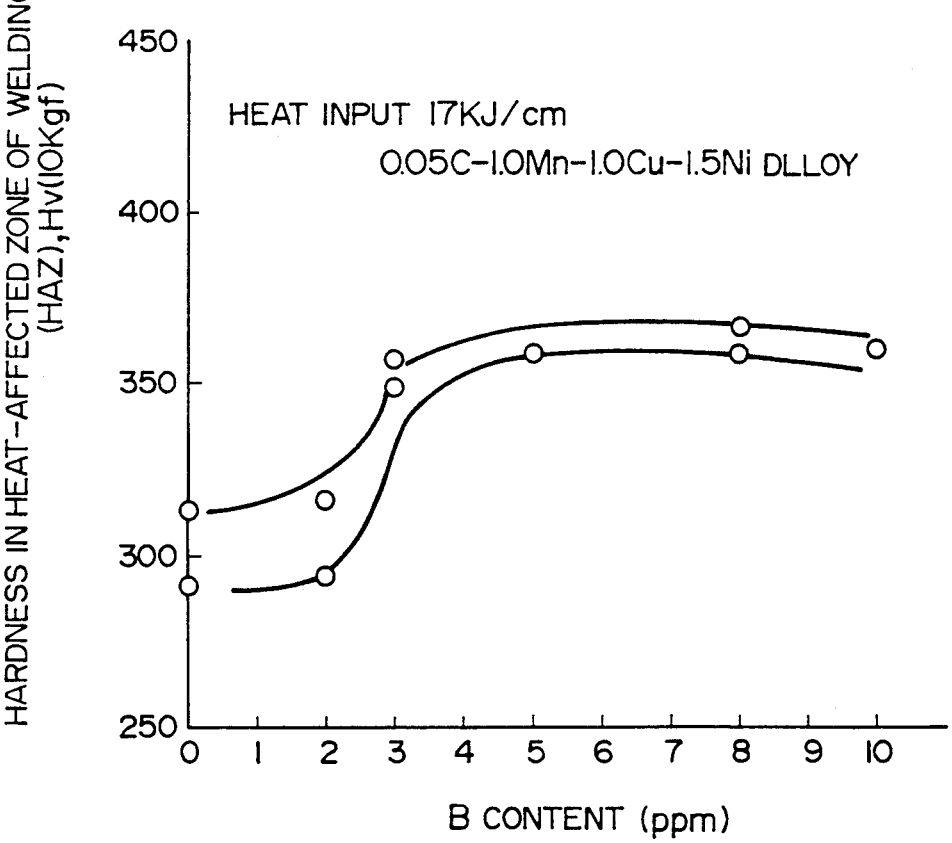
FIG. 2 is a graph showing the influence of B content of steel composition on the hardness of HAZ of welding.

Examples of the invention will be given hereinafter. Billets were prepared by a melting process from various steel compositions as shown in Table 1, and were formed into steel plates of 25 to 150 mm thick, through the method of the invention and also through comparison methods shown in Table 2. Mechanical properties of the matrix material, hardness of the HAZ of welding and $K_{ISCC}$ value (critical destruction toughness value relating to stress corrosion cracking resistance) were measured with respect to these steel plates. The welding was conducted by shielded arc welding at a small heat input of 17 to 25 KJ/cm so as to create a severe hardening condition on the HAZ of welding.

Mechanical properties of the steel samples obtained from steel compositions shown in Table 1 through processes shown in Table 2 are shown in Table 3. Table 3 also shows the results of a $K_{ISCC}$ test on HAZ of welding conducted by using test pieces specified in ASTM E399 in an artificial sea water of 3.5% concentration.

TABLE 1

| | STEELS | C | Si | Mn | P | S | Cu | Ni | Mo | Ti | Al |
|---|---|---|---|---|---|---|---|---|---|---|---|
| STEEL COMPOSITIONS ACCORDING TO THE INVENTION | A | 0.05 | 0.25 | 1.32 | 0.006 | 0.001 | 1.18 | 1.46 | 0.21 | 0.012 | 0.029 |
| | B | 0.03 | 0.30 | 0.95 | 0.003 | 0.001 | 1.55 | 3.80 | 0.06 | 0.008 | 0.045 |
| | C | 0.02 | 0.35 | 0.72 | 0.005 | 0.003 | 1.35 | 3.52 | 0.80 | 0.024 | 0.020 |
| | D | 0.03 | 0.12 | 0.58 | 0.009 | 0.002 | 0.53 | 1.08 | 1.35 | 0.010 | 0.038 |
| | E | 0.04 | 0.24 | 1.15 | 0.008 | 0.001 | 1.72 | 0.58 | 0.46 | 0.015 | 0.057 |
| | F | 0.05 | 0.22 | 0.98 | 0.008 | 0.003 | 1.09 | 1.48 | 0.50 | 0.013 | 0.042 |
| | G | 0.04 | 0.25 | 1.34 | 0.009 | 0.001 | 1.35 | 2.43 | 0.49 | 0.014 | 0.043 |
| | H | 0.03 | 0.40 | 1.22 | 0.004 | 0.002 | 0.98 | 3.58 | 0.27 | 0.009 | 0.029 |
| | I | 0.04 | 0.20 | 1.03 | 0.005 | 0.001 | 1.02 | 0.75 | 0.45 | 0.012 | 0.036 |
| | J | 0.04 | 0.23 | 0.75 | 0.005 | 0.004 | 1.54 | 3.47 | 0.40 | 0.028 | 0.026 |
| | K | 0.05 | 0.10 | 0.85 | 0.007 | 0.002 | 1.25 | 0.47 | 0.40 | 0.006 | 0.042 |
| COMPARISON STEEL COMPOSITIONS | L | 0.12 | 0.27 | 0.87 | 0.009 | 0.003 | 0.24 | 0.25 | 0.35 | — | 0.066 |
| | M | 0.11 | 0.25 | 0.97 | 0.008 | 0.002 | 0.17 | 0.90 | 0.42 | — | 0.057 |
| | N | 0.07 | 0.24 | 0.68 | 0.003 | 0.001 | — | 3.90 | 0.48 | — | 0.032 |
| | O | 0.04 | 0.30 | 1.20 | 0.004 | 0.002 | 1.55 | 0.61 | 0.45 | 0.025 | 0.052 |

| | STEELS | N | B | Cr | Nb | V | Ca | Ceq | Pcm | $Ar_3$ |
|---|---|---|---|---|---|---|---|---|---|---|
| STEEL COMPOSITIONS ACCORDING TO THE INVENTION | A | 0.0035 | 0 | — | — | — | — | 0.37 | 0.23 | 693 |
| | B | 0.0028 | 0 | — | — | — | — | 0.45 | 0.27 | 647 |
| | C | 0.0073 | 0.0002 | — | — | — | 0.0032 | 0.44 | 0.25 | 688 |
| | D | 0.0030 | 0 | — | — | — | — | 0.50 | 0.20 | 809 |
| | E | 0.0055 | 0.0001 | — | — | — | — | 0.37 | 0.24 | 737 |
| | F | 0.0040 | 0 | 0.35 | 0.016 | — | 0.0025 | 0.45 | 0.24 | 717 |
| | G | 0.0050 | 0.0001 | — | 0.030 | — | — | 0.46 | 0.26 | 665 |
| | H | 0.0031 | 0 | 0.49 | 0.025 | — | — | 0.51 | 0.26 | 629 |
| | I | 0.0042 | 0.0002 | 0.82 | — | 0.035 | — | 0.52 | 0.24 | 731 |
| | J | 0.0085 | 0 | 0.50 | 0.015 | — | 0.0042 | 0.46 | 0.28 | 649 |
| | K | 0.0030 | 0 | — | — | 0.90 | — | 0.37 | 0.29 | 761 |
| COMPARISON STEEL COMPOSITIONS | L | 0.0025 | 0.0012 | 0.85 | — | 0.038 | — | 0.54 | 0.26 | 743 |
| | M | 0.0032 | 0.0008 | 0.54 | — | 0.053 | 0.0023 | 0.52 | 0.26 | 727 |
| | N | 0.0039 | 0 | 0.63 | — | 0.037 | — | 0.54 | 0.25 | 657 |
| | O | 0.0055 | 0.0004 | — | — | — | — | 0.38 | 0.23 | 737 |

Note 1 Ceq: C + Si/24 + Mn/6 + Ni/40 + Cr/5 + Mo/4 + V/14 (%)
Note 2 Pcm: C + Si/30 + Mn/20 + Cu/20 + Ni/60 + Cr/20 + Mo/15 + V/10 + 5B (%)
Note 3 $Ar_3$: −396 C + 24.6 Si − 68.1 Mn − 36.1 Ni − 20.7 Cu − 24.8 Cr + 29.6 Mo + 868 (°C.)

TABLE 2

| | PRODUCTION PROCESS CONDITION NO. | HEATING/ROLLING/WATER-COOLING | | | |
|---|---|---|---|---|---|
| | | BILLET HEATING TEMP. (°C.) | RECRYSTALLIZATION RANGE ROLLING START TEMP. (°C.) | RECRYSTALLIZATION RANGE ROLLING REDUCTION (°C.) | NON-RECRYSTALLIZATION RANGE ROLLING START TEMP. (°C.) |
| PROCESS CONDITIONS OF INVENTION | 1 | 1000 | 950 | 65 | 820 |
| | 2 | 980 | 920 | 45 | 800 |
| | 3 | 980 | 940 | 40 | 840 |
| | 4 | 980 | 890 | 45 | 835 |
| | 5 | 1000 | 930 | 50 | 850 |
| | 6 | 950 | 925 | 50 | 820 |
| | 7 | 900 | 875 | 50 | 800 |
| | 8 | 1000 | 900 | 50 | 790 |
| | 9 | 1000 | 900 | 65 | 815 |
| | 10 | 950 | 890 | 40 | 780 |
| PROCESS CONDITIONS OF COMPARISON EXAMPLES | 11 | 1000 | 880 | 50 | 800 |
| | 12 | 1000 | 950 | 85 | — |
| | 13 | 1150 | 970 | 55 | 850 |
| | 14 | 1150 | 950 | 80 | 850 |
| | 15 | 1000 | 900 | 50 | 845 |
| | 16 | 1000 | — | — | 800 |

TABLE 2-continued

| | | | | | |
|---|---|---|---|---|---|
| | 17 | 1250 | 1000 | 75 | — |
| | 18 | 1000 | 950 | 50 | 820 |

| | PRODUCTION PROCESS CONDITION NO. | HEATING/ROLLING/WATER-COOLING | | | TEMPERING CONDITIONS |
|---|---|---|---|---|---|
| | | NON-RECRYSTALLIZATION RANGE ROLLING REDUCTION (°C.) | WATER-COOLING START TEMP. (°C.) | WATER-COOLING TERMINATION TEMP. (°C.) | TEMPERING TEMP. (°C.) |
| PROCESS CONDITIONS OF INVENTION | 1 | 35 | 750 | 30 | 600 |
| | 2 | 35 | 775 | 40 | 650 |
| | 3 | 50 | 800 | 75 | 640 |
| | 4 | 35 | 815 | 50 | 620 |
| | 5 | 40 | 790 | 75 | 600 |
| | 6 | 45 | 780 | 50 | 640 |
| | 7 | 30 | 765 | 200 | 660 |
| | 8 | 45 | 775 | 100 | 665 |
| | 9 | 25 | 800 | 50 | 650 |
| | 10 | 35 | 750 | 100 | 635 |
| PROCESS CONDITIONS OF COMPARISON EXAMPLES | 11 | 30 | 795 | 50 | 600 |
| | 12 | — | 900 | 30 | 630 |
| | 13 | 25 | 825 | 75 | 640 |
| | 14 | 20 | 810 | 30 | 635 |
| | 15 | 30 | 820 | 100 | 600 |
| | 16 | 75 | 700 | 50 | 600 |
| | 17 | — | 910 | 50 | 600 |
| | 18 | 45 | 790 | 350 | 640 |

TABLE 3-1

| | PROCESS CONDITIONS | STEEL | PLATE THICKNESS (mm) | WIDTHWISE POSITION FOR MEASURING PLATE THICKNESS | MATRIX MATERIAL TENSILE TEST | |
|---|---|---|---|---|---|---|
| | | | | | YIELD STRENGTH (Kgf/mm$^2$) | TENSILE STRENGTH (Kgf/mm$^2$) |
| SAMPLES ACCORDING TO THE INVENTION | 1 | A | 25 | UNDER SKIN LAYER | — | — |
| | | | | ¼ t | 78.4 | 85.5 |
| | | | | ½ t | 78.5 | 85.7 |
| | 2 | B | 90 | UNDER SKIN LAYER | 75.3 | 83.7 |
| | | | | ¼ t | 74.5 | 82.2 |
| | | | | ½ t | 74.6 | 82.4 |
| | 3 | C | 90 | UNDER SKIN LAYER | 73.4 | 83.6 |
| | | | | ¼ t | 73.1 | 83.5 |
| | | | | ½ t | 72.8 | 83.1 |
| | 4 | D | 75 | UNDER SKIN LAYER | 75.1 | 84.5 |
| | | | | ¼ t | 75.4 | 84.7 |
| | | | | ½ t | 75.2 | 84.0 |
| | 5 | E | 50 | UNDER SKIN LAYER | 73.2 | 83.8 |
| | | | | ¼ t | 72.5 | 83.4 |
| | | | | ½ t | 72.4 | 83.1 |
| | 6 | F | 100 | UNDER SKIN LAYER | 74.9 | 84.7 |
| | | | | ¼ t | 74.3 | 84.8 |
| | | | | ½ t | 74.0 | 84.5 |

| | | PROCESS CONDITIONS | MATRIX MATERIAL IMPACT STRENGTH TEST | | HAZ HARDNESS ($H_v$10 kg) | CRITICAL $K_{ISCC}$ OF HAZ (Kgf-mm$^{-3/2}$) |
|---|---|---|---|---|---|---|
| | | | $_v$Trs (°C.) | $_v$E$_{-60}$ (Kgf-m) | | |
| | SAMPLES ACCORDING TO THE INVENTION | 1 | — | — | 295 | >650 |
| | | | −110 | 25.2 | | |
| | | | −110 | 25.0 | | |
| | | 2 | −95 | 28.3 | 336 | — |
| | | | −95 | 28.1 | | |
| | | | −90 | 27.2 | | |
| | | 3 | −105 | 27.0 | 324 | 600 |
| | | | −100 | 26.2 | | |
| | | | −100 | 26.5 | | |
| | | 4 | −100 | 27.8 | 345 | — |
| | | | −100 | 27.5 | | |
| | | | −95 | 27.2 | | |
| | | 5 | −90 | 25.2 | 309 | — |
| | | | −90 | 25.3 | | |
| | | | −85 | 25.0 | | |
| | | 6 | −95 | 24.1 | 335 | 620 |
| | | | −90 | 23.8 | | |
| | | | −90 | 23.2 | | |

TABLE 3-2

| | PROCESS CONDITIONS | STEEL | PLATE THICKNESS (mm) | WIDTHWISE POSITION FOR MEASURING PLATE THICKNESS | MATRIX MATERIAL TENSILE TEST YIELD STRENGTH (Kgf/mm²) | MATRIX MATERIAL TENSILE TEST TENSILE STRENGTH (Kgf/mm²) |
|---|---|---|---|---|---|---|
| SAMPLES ACCORDING TO THE INVENTION | 7 | G | 120 | UNDER SKIN LAYER | 76.3 | 86.2 |
| | | | | ¼ t | 76.2 | 86.0 |
| | | | | ½ t | 74.7 | 85.5 |
| | 8 | H | 1000 | UNDER SKIN LAYER | 76.0 | 85.1 |
| | | | | ¼ t | 75.3 | 84.7 |
| | | | | ½ t | 75.1 | 84.2 |
| | 9 | I | 75 | UNDER SKIN LAYER | 74.7 | 85.3 |
| | | | | ¼ t | 74.2 | 85.1 |
| | | | | ½ t | 73.8 | 84.6 |
| | 10 | J | 150 | UNDER SKIN LAYER | 76.2 | 85.5 |
| | | | | ¼ t | 75.8 | 84.2 |
| | | | | ½ t | 74.3 | 83.8 |
| | 11 | K | 50 | UNDER SKIN LAYER | 74.5 | 83.6 |
| | | | | ¼ t | 74.4 | 83.3 |
| | | | | ½ t | 73.9 | 82.7 |
| | 12 | L | 40 | UNDER SKIN LAYER | — | — |
| | | | | ¼ t | 78.3 | 87.7 |
| | | | | ½ t | 78.2 | 87.5 |

| | PROCESS CONDITIONS | MATRIX MATERIAL IMPACT STRENGTH TEST $_{v}$Trs (°C.) | MATRIX MATERIAL IMPACT STRENGTH TEST $_{v}E_{-60}$ (Kgf-m) | HAZ HARDNESS ($H_v$10 kg) | CRITICAL $K_{ISCC}$ OF HAZ (Kgf-mm$^{-3/2}$) |
|---|---|---|---|---|---|
| SAMPLES ACCORDING TO THE INVENTION | 7 | −100 | 25.8 | 346 | — |
| | | −100 | 25.8 | | |
| | | −95 | 25.6 | | |
| | 8 | −100 | 28.7 | 351 | 580 |
| | | −100 | 28.3 | | |
| | | −110 | 28.9 | | |
| | 9 | −120 | 25.2 | 357 | — |
| | | −120 | 25.0 | | |
| | | −115 | 24.5 | | |
| | 10 | −100 | 25.5 | 343 | — |
| | | −105 | 25.3 | | |
| | | −100 | 25.3 | | |
| | 11 | −95 | 23.7 | 288 | >650 |
| | | −95 | 23.5 | | |
| | | −85 | 23.0 | | |
| | 12 | — | — | 432 | 350 |
| | | −70 | 15.0 | | |
| | | −70 | 14.2 | | |

TABLE 3-3

| | PROCESS CONDITIONS | STEEL | PLATE THICKNESS (mm) | WIDTHWISE POSITION FOR MEASURING PLATE THICKNESS | MATRIX MATERIAL TENSILE TEST YIELD STRENGTH (Kgf/mm²) | MATRIX MATERIAL TENSILE TEST TENSILE STRENGTH (Kgf/mm²) |
|---|---|---|---|---|---|---|
| SAMPLES ACCORDING TO THE INVENTION | 13 | M | 75 | UNDER SKIN LAYER | 80.2 | 89.6 |
| | | | | ¼ t | 76.1 | 85.3 |
| | | | | ½ t | 73.4 | 83.8 |
| | 14 | N | 75 | UNDER SKIN LAYER | 79.3 | 89.7 |
| | | | | ¼ t | 73.8 | 84.2 |
| | | | | ½ t | 68.7 | 79.0 |
| | 15 | O | 50 | UNDER SKIN LAYER | 76.5 | 87.8 |
| | | | | ¼ t | 76.2 | 87.2 |
| | | | | ½ t | 75.7 | 86.6 |
| | 16 | A | 25 | UNDER SKIN LAYER | — | — |
| | | | | ¼ t | 68.5 | 76.5 |
| | | | | ½ t | 68.4 | 86.2 |
| | 17 | E | 50 | UNDER SKIN LAYER | 76.2 | 85.7 |
| | | | | ¼ t | 75.8 | 85.3 |
| | | | | ½ t | 68.7 | 78.5 |
| | 18 | F | 100 | UNDER SKIN LAYER | 70.1 | 80.0 |
| | | | | ¼ t | 65.4 | 76.9 |
| | | | | ½ t | 63.5 | 74.8 |

| | PROCESS CONDITIONS | MATRIX MATERIAL IMPACT STRENGTH TEST $_{v}$Trs (°C.) | MATRIX MATERIAL IMPACT STRENGTH TEST $_{v}E_{-60}$ (Kgf-m) | HAZ HARDNESS ($H_v$10 kg) | CRITICAL $K_{ISCC}$ OF HAZ (Kgf-mm$^{-3/2}$) |
|---|---|---|---|---|---|

TABLE 3-3-continued

| | | | | | |
|---|---|---|---|---|---|
| SAMPLES ACCORDING TO THE INVENTION | 13 | −70 | 10.4 | 425 | 380 |
| | | −95 | 24.2 | | |
| | | −65 | 9.5 | | |
| | 14 | −70 | 13.2 | 412 | — |
| | | −85 | 22.0 | | |
| | | −60 | 9.8 | | |
| | 15 | −100 | 25.1 | 401 | 390 |
| | | −100 | 25.3 | | |
| | | −95 | 24.7 | | |
| | 16 | — | — | 298 | — |
| | | −65 | 16.5 | | |
| | | −65 | 15.7 | | |
| | 17 | −90 | 22.4 | 302 | — |
| | | −80 | 20.7 | | |
| | | −50 | 6.8 | | |
| | 18 | −85 | 20.8 | 332 | — |
| | | −70 | 16.0 | | |
| | | −65 | 10.2 | | |

The sample steel plates 1-A to 11-K according to the invention, which were produced from steel compositions specified by the invention under process conditions of the invention, showed high strength and toughness values of the matrix steels, with small variation of strength and toughness values in the direction of thickness of the plates. Accordingly, HAZ in these sample steel plates showed sufficiently large $K_{ISCC}$ values. Comparison sample steel plates 12-L and 130M, which had large C contents and contain noticeable amounts of B, showed extremely high hardness levels of HAZ, as well as low $K_{ISCC}$ values in HAZ. In addition, these comparison sample steel plates showed a large variation of toughness in the thicknesswise direction due to no addition of Ti which makes crystal grains fine in size. More specifically, in the comparison sample steel plate 13-M, a coarse martensitic structure occurring under the skin layer and coarse upper bainite structure were observed in the thicknesswise mid portion, thus exhibiting a reduction in the toughness. A comparison sample steel plate 14-N showed a high HAZ hardness due to large C content. In addition, in this comparison sample steel plate there occured a variation in the toughness in the thicknesswise direction because of no addition of Ti and to high heating temperature and because of the hot-rolling condition which consists of rolling in the recrystallizing temperature range alone. More specifically, the comparison sample steel plate 14N had a coarse martensitic structure under the skin layer and a coarse upper bainite structure in the thicknesswise mid portion, thus exhibiting inferior toughness. A comparison sample steel plate 15-O showed a high HAZ hardness and, hence, low $K_{ISCC}$ value due to addition of a trace amount (4 ppm) of B. The comparison sample steel plate 16-A was obtained through a process in which hot rolling was conducted only in the non-recrystallization temperature range. In consequence, this comparison sample steel plate showed an upper bainite structure occurring from long and coarse austenitic grains, thus exhibiting inferior strength and toughness even at such a position as $\frac{1}{4}$ t ($\frac{1}{4}$ thickness) from the upper side.

A sample steel plate 5-E of 50 mm thick was prepared from the steel composition E through a process of the invention, while a comparison sample steel plate 17-E was prepared by a comparison process from the same steel composition E. The sample steel plate 5-E prepared through the method of the invention had fine upper bainite structure even in the thicknesswise mid portion of the plate, thus attaining the desired performance. In contrast, the comparison sample steel plate 17-E could not attain the desired strength and toughness due to formation of coarse bainite structure. This is attributable to insufficiency in the precipitation hardening due to the omission of hot rolling in the non-recrystallization temperature range. A comparison sample steel plate 8-F also showed inferior strength due to insufficient precipitation attributable to high temperature at which the water-cooling terminated.

As will be fully realized from the foregoing description, it is possible to produce a 80 kgf/mm$^2$ high tension steel superior in anti-weld-hardening characteristic, stress corrosion cracking resistance and low temperature toughness. By using the high tension steel produced by the method of the invention, it is possible to remarkably improve the efficiency of welding operation to be conducted at the site of building of a steel structure and to enhance safety of the welded structure under various conditions of use.

Although the invention has been described through its specific terms, it is to be understood that the invention can be carried out in various ways within the scope of the invention which is limited solely by the appended claims.

WHAT IS CLAIMED IS:

1. A method of producing a high tension steel superior in weldability and low temperature toughness, comprising the steps of:

preparing a steel billet having a composition consisting, by weight, of 0.02 to 0.05% C, 0.02 to 0.5% Si, 0.4 to 1.5% Mn, 0.5 to 4.0% Ni. 0.20 to 1.5% Mo, 0.005 to 0.03% Ti, 0.01 to 0.08% Al, not more than 0.0002% B, 0.5 to 2.0% Cu, not more than 0.01% N, and the balance Fe and incidental impurities;

heating said steel billet to a temperature of 900° C. to 1000° C.;

hot-rolling the heated steel billet first at a rolling reduction of 30 to 70% in a temperature range in which austenite recrystallizes and then at a rolling reduction of 20 to 60% in another temperature range in which austenite does not recrystallizes;

hardening the hot-rolled billet by watercooling from a temperature not lower than the $Ar_3$ transformation point and terminating the cooling at a temperature not higher than 250° C.; and tempering the hardened billet at a temperature which is not higher than the $Ac_1$ transformation point.

2. A method of producing a high tension steel superior in weldability and low temperature toughness, comprising the steps of:

preparing a steel billet having a composition consisting, by weight, of 0.02 to 0.05% C, 0.02 to 0.5% Si, 0.4 to 1.5% Mn, 0.5 to 4.0% Ni. 0.20 to 1.5% Mo, 0.005 to 0.03% Ti, 0.01 to 0.08% Al, not more than 0.0002% B, 0.5 to 2.0% Cu, not more than 0.01% N, at least one selected from the group consisting of 0.0005 to 0.005% Ca having function of controlling the morphology of inclusion and strength-improving elements consisting of 0.05 to 1.0% Cr, 0.005 to 0.10% V and 0.005 to 0.05% Nb, and the balance Fe and incidental impurities;

heating said steel billet to a temperature of 900° C. to 1000° C.;

hot-rolling the heated steel billet first at a rolling reduction of 30 to 70% in a temperature range in which austenite recrystallizes and then at a rolling reduction of 20 to 60% in another temperature range in which austenite does not recrystallizes;

hardening the hot-rolled billet by water-cooling from a temperature not lower than the $Ar_3$ transformation point and terminating the cooling at a temperature not higher than 250° C.; and tempering the hardened billet at a temperature which is not higher than the $Ac_1$ transformation point.

* * * * *